United States Patent [19]

Harris

[11] 4,069,527

[45] Jan. 24, 1978

[54] PROTECTIVE BED CANOPY

[76] Inventor: William C. Harris, Apartado 218, San Pedro Sula, Honduras

[21] Appl. No.: 725,403

[22] Filed: Sept. 22, 1976

[51] Int. Cl.[2] ..... A47C 29/00

[52] U.S. Cl. ..... 5/362; 52/86; 52/639

[58] Field of Search ..... 5/362; 52/639, 644, 52/86

[56] References Cited

U.S. PATENT DOCUMENTS

| | | | |
|---|---|---|---|
| 181,481 | 8/1876 | Rollert | 5/362 |
| 493,305 | 3/1893 | Sherman | 5/362 |
| 1,021,930 | 4/1912 | Jackson | 5/362 |
| 1,635,231 | 7/1927 | St. John | 52/639 |
| 1,708,855 | 4/1929 | Thompson | 5/362 |
| 2,573,455 | 10/1951 | Koontz | 5/362 |
| 2,693,195 | 11/1954 | Frieder et al. | 52/644 |
| 2,760,450 | 8/1956 | Findleton | 52/639 |
| 3,741,225 | 6/1973 | Gunter | 5/362 |

*Primary Examiner*—Paul R. Gilliam
*Assistant Examiner*—A. Grosz
*Attorney, Agent, or Firm*—Harrington A. Lackey

[57] ABSTRACT

An overhead protective device for a bed including a canopy having a framework composed of a plurality of longitudinal and transverse trusses, a layer of wire network and an ornamental layer of fabric, all supported upon reinforced standards or posts projecting upward from the corners of the bed frame.

3 Claims, 3 Drawing Figures

PROTECTIVE BED CANOPY

BACKGROUND OF THE INVENTION

This invention relates to a bed canopy, and more particularly to a protective bed canopy.

Overhead canopies are, of course, known in the art for use on four-poster beds. However, such canopies are strictly for decorative purposes.

Reinforced shelters and even reinforced furniture, are known for reception or concealment of persons in order to protect them from flying or falling debris and heavy obstacles resulting from structural failure of buildings, bombings, earthquakes tornados and other major catastrophes.

However, it is not believed that a canopy has been designed of a construction sufficiently strong for protecting the occupant of a bed from such catastrophes.

SUMMARY OF THE INVENTION

It is therefore an object of this invention to provide an overhead device from a bed for protecting the occupant thereof from heavy falling or flying objects, such as the collapse of the roof of the room in which the bed is located, during major disasters and calamities, such as war, bombings, earthquakes, tornados or other catastrophes.

The protective bed canopy made in accordance with this invention includes a canopy made from a plurality of intersecting and interconnecting longitudinal and transverse trusses, spaced above and spanning the length and width of the bed. The canopy further includes a layer of wire network, such as open mesh or chain-link wire completely covering the truss framework and another layer of decorative fabric for covering the entire canopy.

The four corners of the truss framework are provided with connectors adapted to be attached or secured to mating connectors on the top of reinforced posts or standards projecting upward, preferably from the four corners of the bed. If the standards are desired to be made of wood, each wooden standard includes a steel reinforcing core. The standards might also be made entirely of steel or other structurally strong material.

The framework preferably has an arched cross-section to deflect falling objects to the sides of the canopy, as well as to resist the impact of such objects.

DESCRIPTION OF THE PREFERRED EMBODIMENT

Figure 1:
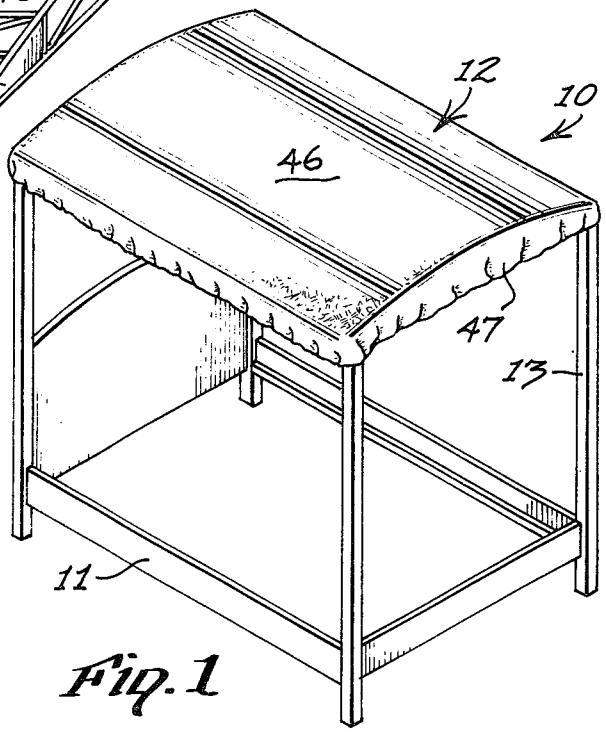
FIG. 1 is a top perspective view of the protective canopy supported over a bed.
Figure 2:
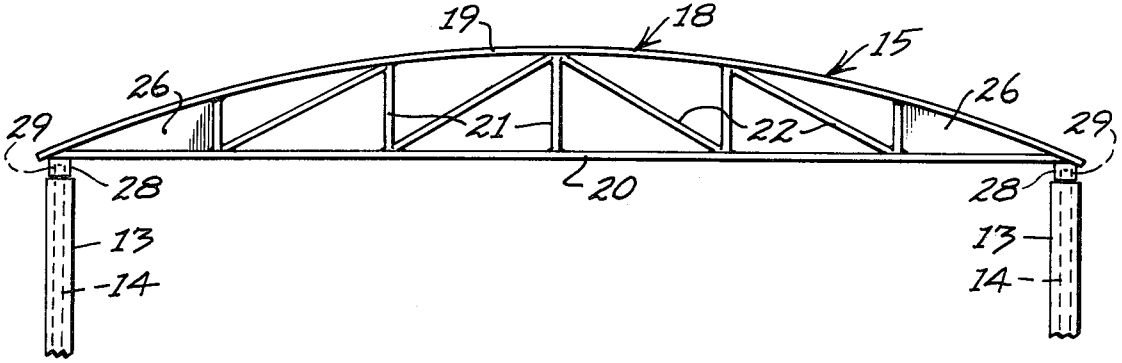
FIG. 2 is an enlarged fragmentary front elevation of the canopy framework and the upper portions of the bedposts.
Figure 3:
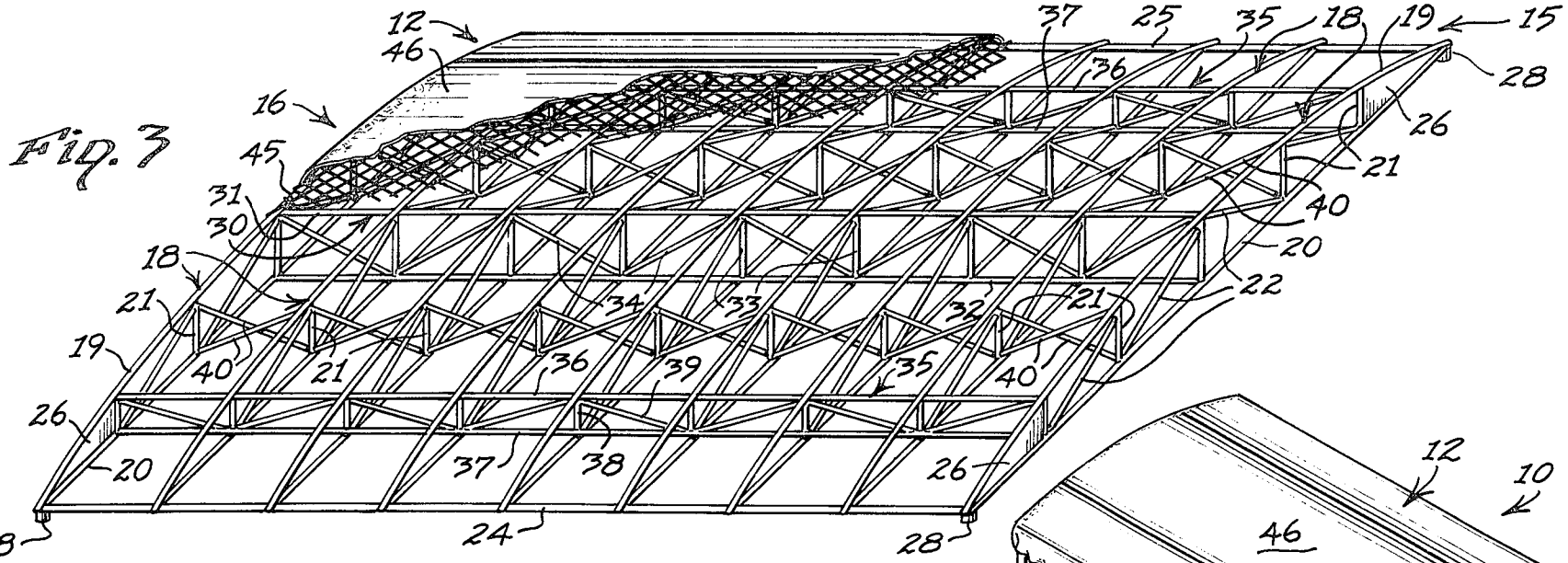
FIG. 3 is an enlarged, fragmentary, top perspective view of the canopy, with portions of the cover fabric and wire network broken away.

Referring now to the drawings in more detail, FIG. 1 discloses the overhead protective device 10 for a bedframe 11. The overhead protective device 10 includes a protective canopy 12 supported at its four corners upon upstanding, reinforced bed posts or standards 13. As disclosed in the drawings, the bed posts or standards 13 are made of wood, but have solid steel reinforcing rods 14 as cores within the wooden posts 13.

The canopy 12 is as long and as wide as the bedframe 11 in order to fully protect the occupant of the bed from falling objects. The canopy 12 includes a framework 15 and a cover member 16.

The framework 15 is formed of a plurality of longitudinally spaced transverse trusses 18 which have an arched top rod 19 and an elongated straight bottom rod 20 secured together by alternating vertical struts 21 and diagonal struts 22. Each arched top rod 19 is convex upward and its ends converge toward and are connected to the opposite ends of the corresponding bottom rod 20. The merging ends of each top rod 19 and its corresponding bottom rod 20 are also connected to elongated straight side rods or rod members 24 and 25, which form the longitudinal side edges of the framework 15.

The converging ends of the top rod 18 and bottom rod 20 of each end arcuate truss 18 are further reinforced by solid gusset plates 26. The ends of these end arcuate trusses 18 are further provided with depending connectors 28 in the form of sockets for detachable receiving upstanding pins 29 projecting upward from each of the corner bed posts 13.

Extending longitudinally the length of and centrally of the canopy framework 15 is a central longitudinal truss 30 intersecting and interconnecting the central portions of each of the transverse trusses 18. The central longitudinal truss 30 is made up of horizontal, straight, top and bottom longitudinal rods 31 and 32, connected by alternating vertical struts 33 and diagonal struts 34.

In a similar manner, longitudinal side trusses 35 extend the length of the canopy framework 15, but are spaced laterally on each side of the central longitudinal truss 30. The side trusses 35 also interconnect corresponding portions of each of the transverse trusses 18. Each of the side longitudinal trusses 35 include straight, horizontal, longitudinal top rods 36 and bottom rods 37, connected by alternating vertical struts 38 and diagonal struts 39.

Each of the longitudinal trusses 30 and 35, as well as the transverse trusses 18, are disposed in corresponding vertical planes, the longitudinal trusses 30 and 35 intersecting the transverse trusses 18 at right angles. The height of the side longitudinal trusses 35 are less than the height of the central truss 30, their height corresponding to the height of the respective intersecting portions of the transverse arcuate trusses 18.

For additional reinforcement, cross brace members or struts 40, crossed in vertical longitudinal planes, are fixed at their opposite ends to corresponding vertical struts 21 in the transverse trusses 18. The cross brace members 40 are transversely spaced between the central longitudinal truss 30 and the side trusses 35.

The cover 16 includes a layer of wire network 45 in the form of open mesh, heavy duty screen or chain-link wire, to cover the entire top surface of the canopy framework 15. Such heavy wire network 45 not only provides additional resistance to falling objects, but with some flexibility tends to absorb the shock of the falling objects, as well as preventing such objects from penetrating the spaces between the various trusses 18, 30 and 35.

The cover 16 also includes a fabric layer or sheet material 46 which is placed over the top of the wire network 45 in order to conceal, not only the wire network 45, but also the entire truss framework 15. The fabric layer 46 is predominantly for the sake of appearance and may be attractively decorated, such as with ruffles 47 (FIG. 1).

The overhead protective device 10 is particularly useful on bedframes 11 located in areas likely to be subjected to natural calamities, such as earthquakes, hurricanes or tornados, which might cause damage to the building within which the bedframe 11 is situated. Thus, the person on the bedframe 11, while sleeping, will be protected from falling objects and debris should the building be destroyed or the roof cave in on top of the canopy 12.

The network of longitudinal and transverse trusses 18, 30 and 35, as well as the cross braces 40, together with the wire network 45 in the cover 16, will withstand substantial weight and forces of flying and falling objects and debris. The arched design of the transverse trusses 18 further provides means for deflecting objects to each side of the longitudinal center line of the canopy 15, as well as providing additional compressive strength within the top arched rods 18 for resisting failure under the impact of heavy falling objects.

It will be understood that the dimensions of the canopy 12 may be varied to accommodate the size of the bed over which the canopy 12 is supported.

It will also be understood that connectors others than the sockets 28 and pins 29 might be used. In fact, the sockets 28 and the pins 29 might be reversed so that the pins 29 depend from the corners of the truss frame 14, while the sockets 28 could be formed within the top faces of the bed posts 13.

The size of the rods and struts may be varied, as well as the number and spacing of the trusses 18, 30 and 35 in order to obtain a structural design to withstand the maximum forces and weights contemplated in a particular potential disaster area.

The truss design of the framework 15 provides maximum strength-to-weight ratio. Accordingly, the struts and rods in the various trusses are preferably made from steel.

What is claimed is:

1. An overhead protective device for a bed having a bed frame for protecting the occupant of the bed during a catastrophe, comprising:

a. a plurality of reinforced standards having upper end portions projecting upward from said bed frame, b. an elongated canopy including a framework and a cover member over said framework, c. said framework comprising a plurality of longitudinally spaced transverse trusses disposed in transversely extending vertical planes, d. each of said transverse trusses comprising a continuously and symmetrically arched top strut member convex upward and an elongated bottom strut member connected to said top strut member by intermediate struts, e. said framework further comprising a plurality of transversely spaced, longitudinal trusses disposed in longitudinally extending vertical planes, f. said longitudinal trusses intersecting said transverse trusses at right angles, the height of said longitudinal trusses and transverse trusses being equal at their points of intersection, g. said cover member comprising a layer of heavy-duty, open mesh, wire network engaging and conforming to the top surface of the arched top strut members of said framework, h. said cover member further comprising a decorative fabric overlaying said open mesh, wire network, and i. connector means on said framework attached to said upper end portions of said standards to support said canopy spaced above said bed frame to longitudinally and transversely span said bedframe to shield the occupant of said bed from overhead falling objects and to deflect falling objects away from said bed.

2. The invention according to claim 1 in which said connector means comprise mating in and socket connectors.

3. The invention according to claim 1 in which said framework further comprises longitudinal side rod members forming the side edges of and extending the full length of said framework, the adjacent ends of the top and bottom strut members of each transverse truss converging and being connected to said corresponding side rod member.

* * * * *